US006895668B2

(12) United States Patent
Imamura

(10) Patent No.: US 6,895,668 B2
(45) Date of Patent: May 24, 2005

(54) METHOD OF MANUFACTURING AN INK JET RECORDING HEAD

(75) Inventor: Isao Imamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/526,173

(22) Filed: Mar. 15, 2000

(65) Prior Publication Data

US 2003/0146955 A1 Aug. 7, 2003

(30) Foreign Application Priority Data

Mar. 15, 1999 (JP) ..... 11-068328
Mar. 13, 2000 (JP) ..... 2000-068878

(51) Int. Cl.[7] ..... B21D 53/76; G03C 5/04

(52) U.S. Cl. ..... 29/890.1; 29/DIG. 16; 430/5; 430/325; 430/396; 347/63; 347/65

(58) Field of Search ..... 29/890.1, 25.35, 29/611, 830, DIG. 16; 430/5, 320, 325, 326, 396; 347/44, 47, 63, 65

(56) References Cited

U.S. PATENT DOCUMENTS 4,429,027 A * 1/1984 Chambers et al. ..... 430/5
4,450,455 A 5/1984 Sugitani et al.
4,536,468 A * 8/1985 Yasui et al. ..... 430/325 X
4,558,333 A 12/1985 Sugitani et al.
4,565,859 A 1/1986 Murai et al.
4,657,631 A 4/1987 Noguchi
5,331,344 A * 7/1994 Miyagawa et al. ..... 430/320 X
5,458,254 A * 10/1995 Miyagawa et al. ..... 347/63 X
5,478,606 A 12/1995 Ohkuma et al.

FOREIGN PATENT DOCUMENTS

| | | | |
|---|---|---|---|
| JP | 57-208255 | 12/1982 | |
| JP | 57-208256 | 12/1982 | |
| JP | 58-8658 | 1/1983 | |
| JP | 60-161973 | 8/1985 | |
| JP | 61-154947 | 7/1986 | |
| JP | 62-264975 | 11/1987 | |
| JP | 63-221121 | 9/1988 | |
| JP | 64-9216 | 1/1989 | |
| JP | 2-140219 | 5/1990 | |
| JP | 4-10940 | 1/1992 | |
| JP | 4-10941 | 1/1992 | |
| JP | 4-10942 | 1/1992 | |
| JP | 5-124199 | 5/1993 | |
| JP | 6-226984 | * 8/1994 | ..... 347/47 |
| JP | 6-286149 | 10/1994 | |

OTHER PUBLICATIONS

Bhusari et al, Fabrication of Air–Channel Structures for Microfluidic, Microelectromechanical, and Microelectronic Applications, Sep. 2001, IEEE Journel of Microelectromechanical Systems, vol. 10, No. 3, pp. 400–408.*

* cited by examiner

*Primary Examiner*—A. Dexter Tugbang
(74) *Attorney, Agent, or Firm*—Fitzpatrick, Cella, Harper & Scinto

(57) ABSTRACT

A manufacturing method of an ink-jet recording head includes the following steps. An ink-repellent second active energy ray setting resin is coated over a first active energy ray setting resin for forming a liquid path. The first resin is set. Both resins are exposed, and both resins are developed.

6 Claims, 5 Drawing Sheets

METHOD OF MANUFACTURING AN INK JET RECORDING HEAD

BACKGROUND OF THE INVENTION

1. Field of the Invention

The present invention relates to ink-jet recording heads used for ink-jet recording systems where recording liquid droplets are generated and relates to manufacturing methods of the ink-jet recording heads.

2. Brief Description of the Related Art

Ink-jet recording systems (i.e. ink-jet recording heads applied to liquid ejection systems) generally, are constituted of fine recording liquid ejection ports (hereafter referred as "orifice"), liquid paths and a plurality of liquid ejection energy generating elements constituted at portions of the liquid paths. In order to obtain images of high quality by employing such ink-jet recording heads, it is desirable to control an ejecting volume and a velocity of each liquid droplet ejected from the above-mentioned orifice, at the same level.

To attain such requirements, Japanese laid open patents from No. 4-10940 to No. 4-10942 disclose methods that driving signals are supplied to ink-ejection pressure generating elements (electro-thermal energy conversion elements) according to images to be recorded, to generate enough heat to raise an ink temperature immediately up to a higher temperature than nucleate boiling point of the ink so as to generate bubbles in the ink and so as to let ink eject by escaping force of the bubbles into the atmosphere.

For such purpose, an ink-jet recording head having a short distance between an electro-thermal energy conversion element and an orifice (hereinafter referred as "OH distance") is desirable. In the above-mentioned methods, since the OH distance predominantly determines a volume of ejecting ink, it is necessary to keep the precise OH distance with good reproducibility.

As prior arts for manufacturing ink-jet recording heads, for example, Japanese laid open patents Nos. 57-208255 and 57-208256 which disclose methods that glass covers are bonded on nozzles consisting of ink paths fabricated by a patterning procedure of photosensitive resin applied on a base plate where the pressure generating elements are formed and a method disclosed by the Japanese laid open patent No. 61-154947 where ink flow path patterns are formed by soluble resin, and covered with epoxy resin etc. which is cured afterward, and is solved by a suitable solvent to remove the soluble resin after cutting the path patterns.

In above-mentioned manufacturing methods of the ink-jet recording heads, a growing direction of bubbles and an ejection direction of the ink are different, almost perpendicular to each other. And in these ink-jet recording heads, since a distance between a pressure generating element and an orifice is determined by cutting status of the base plate, a cutting accuracy is an important factor to control the above-mentioned distance. However, since the cutting is generally executed by mechanical means such as dicing saw etc., it is difficult to obtain recording heads with higher accuracy.

And as manufacturing methods of ink-jet recording heads characterized in that a growing direction of bubbles and an ejecting direction of ink are the same, Japanese Laid-Open Patent No. 58-8658, for example, discloses a method that a base plate and a dry film as an orifice-forming plate (hereinafter referred to as an "orifice plate") are stuck together via another dry film with patterned liquid paths so as to form orifices by photolithography afterward.

However by any of the above-mentioned methods, it is difficult to manufacture an orifice plate with thin (e.g. less than 20 $\mu$m) and uniform thickness. Even if such an orifice plate is obtained, a connecting procedure of the base plate, where pressure generating elements are formed, with the orifice plate might be extremely difficult due to a fragility of the orifice plate.

In order to overcome such drawbacks, Japanese laid open patent No. 6-286149 suggests the following method. Namely, the method is comprised by the following procedures: a procedure to form ink paths patterned by a soluble resin on the base plate where ejection pressure generating elements are formed; a procedure to form a resin film layer for wall portion of ink paths on the soluble resin layer by solving a solid epoxy resin in a solvent at an ordinary temperature and by coating the epoxy resin solution on the soluble resin pattern; a procedure to form ink ejection ports on the resin film layer at corresponding portions to the ink ejection pressure generating elements; and a procedure to solve the soluble resin layer.

And an ink-repellant treatment is executed on the surfaces of ejection ports obtained by the above-mentioned procedure in order to prevent biased or no ink ejection due to stagnant ink that might generate on the surfaces of the ejection ports. The ink-repellant layers have been formed by a transfer method.

As disclosed in a Japanese laid open patent No. 5-124199, a photolithography method is proposed to form the ink-repellent layers on surfaces of ejection ports more accurately with no ink penetrations into the ejection ports.

Hereinafter a conventional example will be explained according to the above-mentioned technique by referring FIG. 9*a* to FIG. 9*d*.

FIG. 9*a* to FIG. 9*d* show schematic sectional views of a ejection port. In these figures, numeric characters 31, 32, 33 and 34 represent a base plate, an orifice, an ink-repellent photosensitive resin film layer and a photo-mask, respectively.

The base plate 31 for ink-jet recording head having the ejection port 32 shown in FIG. 9*a*, is coated with photosensitive resin layer bearing a ink-repellent property as shown FIG. 9*b* so as to form the photosensitive resin film layer 33 is formed. Then after the photo-mask 34 which does not pass active energy rays, is placed over the photosensitive resin layer, a patterning exposure is executed by irradiating the active energy rays from directions shown by arrows in FIG. 9*c*. When the exposed pattern has been developed by the determined method, for example, by solving and removing non-polymerized (i.e. non-exposed portions) with solvents etc. and thus the ink-repellent photosensitive resin layer 33 has been obtained.

However, since images of high quality and of high resolution have been required, as seen such realized requirements in recent ink-jet printers, the size of every ejection port should be formed so fine that sometimes a some hundreds nano-meter discrepancy between corresponding portions of ejection ports of the liquid path forming material and of the ink-repellent layer, is caused by an insufficient patterning accuracy when patterning of the plate and of the layer are patterned on the same size. Because of the discrepancy, an ink-repellent property around the ejection ports is not so homogenous that the recording quality might be deteriorated.

In order to solve above-mentioned discrepancy, the liquid path forming resin as the first active energy setting material and ink-repellent surface treating resin as the second active energy setting material should be irradiated simultaneously.

However, in the case of the conventionally used spin coating method, there is a problem that since the liquid path forming resin as the first active energy setting material and ink-repellent surface treating resin as the second active energy setting material, are mutually solved, functions of these materials deteriorate, for example, sometimes the liquid path forming resin bears ink-repellent property, the ink-repellent resin decreases its ink-repellent capability etc., and distribution of the thickness of the layer becomes more fluctuated.

SUMMARY OF THE INVENTION

The present invention is carried out to consider the situation mentioned above and its objective is to give a manufacturing method of an ink-recording head to solve above-mentioned problems.

For that purposes the present invention attains above-mentioned objective by giving one of the manufacturing methods from (1) to (6) and by giving ink-jet recording heads according to these manufacturing methods.

(1) A method of manufacturing an ink-jet recording head comprising steps of;

preparing a base plate having an ink ejection pressure generating element, forming a liquid path pattern on the base plate with the use of a soluble resin, applying a first active energy setting material on the base plate and the liquid path pattern, applying an ink-repellent second energy active setting material on the first active energy setting material, exposing the first active energy setting material and the ink-repellent second energy active setting material, developing the first active energy setting material and the ink-repellent second energy setting material so as to form an ejection port above the ink ejection pressure generating element, and removing the liquid path pattern, wherein the ink-repellent second energy active setting material is applied through a drying process.

(2) A method of manufacturing an ink-jet recording head according to (1) wherein; an applying method of the ink-repellent second energy active setting material is characterized by a method of spraying fine particles of the second material.

(3) A method of manufacturing an ink-jet recording head according to (1) wherein; an applying method of the ink-repellent second energy active setting material is characterized by a flexographic printing method.

(4) A method of manufacturing an ink-jet recording head according to (1) wherein; an applying method of the ink-repellent second energy active setting material is characterized by a method of transforming the material into a dry film and by a method of applying the film on the base plate.

(5) A method of manufacturing an ink-jet recording head according to (1) wherein; said first active energy setting material is an epoxy resin cured by the cationic polymerization.

(6) A method of manufacturing an ink-jet recording head according to (1) wherein; said second active energy setting material is an epoxy resin cured by the cationic polymerization.

(7) An ink-jet recording head manufactured by one of above-mentioned methods (1), (2), (3), (4), (5) and (6).

Problems mentioned above are solved with employing the ink-jet recording head obtained by the present invention.

According to the present invention as mentioned above stable ink-repellent area at each ejection port can be formed by patterning the ink-repellent photosensitive material for ejection ports and the ink path forming material simultaneously.

DETAILED DESCRIPTION OF THE PREFERRED EMBODIMENTS

Hereinafter the detailed embodiments according to the present invention are described with reference to examples and the drawings.

Embodiment 1

Based on FIGS. 1 to 8 that are schematic illustrations of the embodiment according to present invention, the embodiment of a manufacturing method according to the present invention will be described pursuant to steps of a manufacturing procedure.

Figure 1:
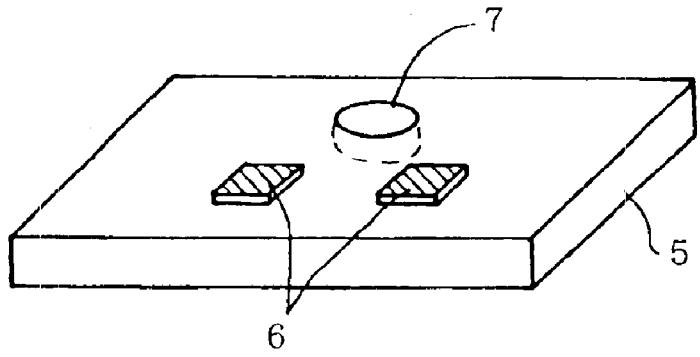
FIG. 1 depicts schematic illustration of an embodiment of manufacturing method of ink-jet recording head (step 1).

As a first step, a base plate 5 such as silicon, glass, ceramics, metal and so on is prepared as shown in FIG. 1. On the base plate 5, a required number (in the figure only two elements which are enough for the description purpose, are shown) of ejection pressure generating elements 6 such as electro-thermal energy conversion elements or piezoelectric elements etc. for ejecting ink are placed. In addition an opening 7 for ink feed is also constituted.

Ejection energy is supplied to ink by above-mentioned ejection pressure generating elements 6 so as to eject fine recording liquid droplets and thus recordings are executed. Incidentally for example, when the electro-thermal energy generating elements are used as the above-mentioned ejection pressure generating elements 6, recording liquid around the elements changes its phase and generates energy for ejection by heat from the elements. In the case of, for example, piezoelectric elements, the ejection energy is supplied by mechanical vibrations.

An electrode (not shown) to input control signal is connected to each element 6 so as to activate the element. Generally, various kinds of functional layers such as protecting layers etc. formed on energy generating elements to increase durability of the elements, are also applicable to the present invention.

Figure 2:
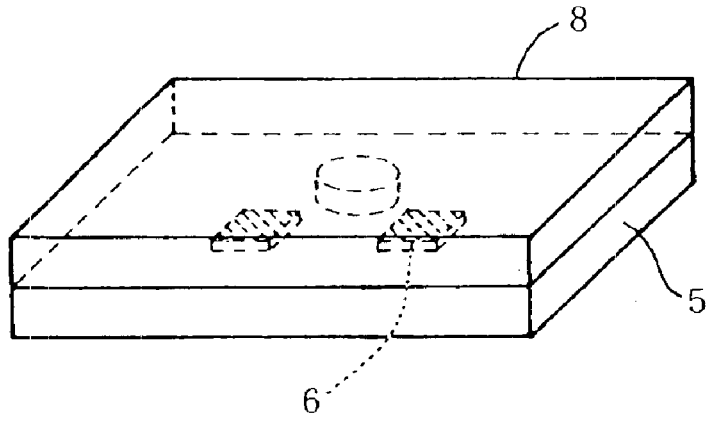
FIG. 2 depicts schematic illustration of the embodiment of manufacturing method of ink-jet recording head (step 2).

Then as shown in FIG. 2, a photosensitive resin layer 8 described below is formed on the base plate 5 so as to cover the pressure generating elements 6 on the plate.

Positive type resist: ODUR1010 (trade name, produced by Tokyo Ohka Kogyo Kabushiki Kaisha)

As a method to form photosensitive resin layer 8, the following procedure comprised successive steps of solving the photosensitive material in an appropriate solvent, of applying the solvent on a dry film such as a PET (polyethylene terephthalate) film etc. and of drying the film can be employed. As the above-mentioned dry film, a photodecomposable polymeric compound derived from vinyl ketone resins such as polymethyl isopropyl ketone and polyvinyl ketone etc. can be preferably employed. The reason is that since these resins have a property (a capability to form film) of polymers before radiating light, the film can easily laminated even on the opening 7 for ink supply.

Figure 3:
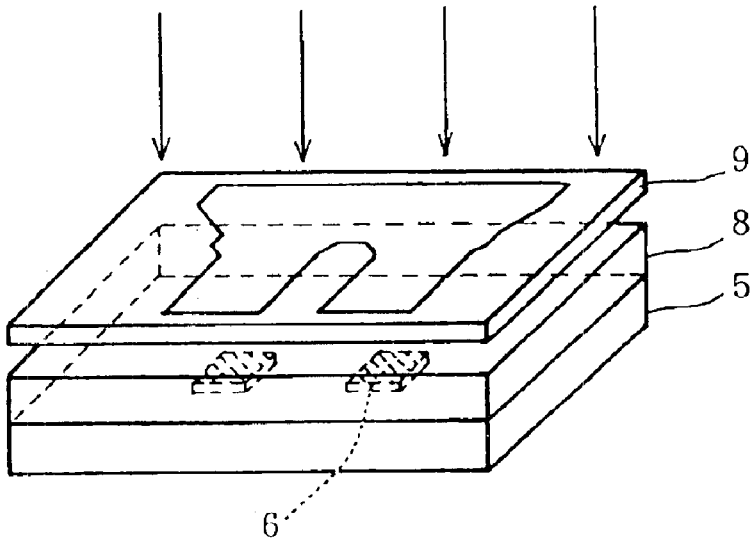
FIG. 3 depicts schematic illustration of the embodiment of manufacturing method of ink-jet recording head (step 3).
Figure 4:
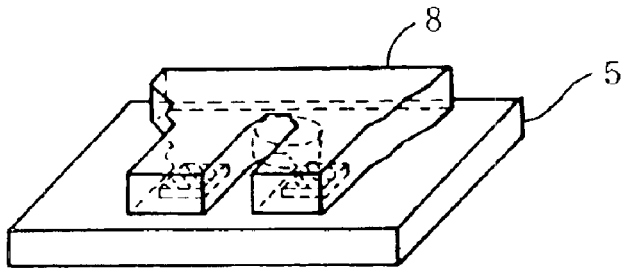
FIG. 4 depicts schematic illustration of the embodiment of manufacturing method of ink-jet recording head (step 4).
Figure 5:
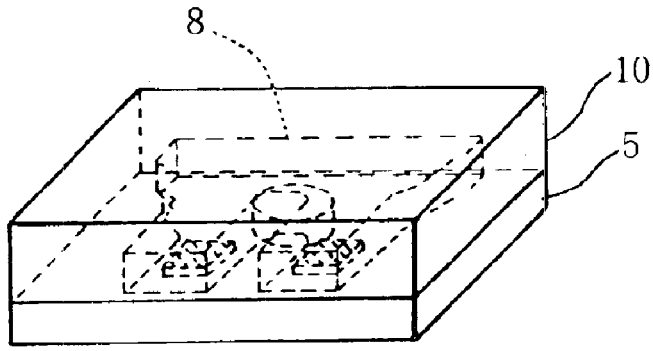
FIG. 5 depicts schematic illustration of the embodiment of manufacturing method of ink-jet recording head (step 5).
Figure 6:
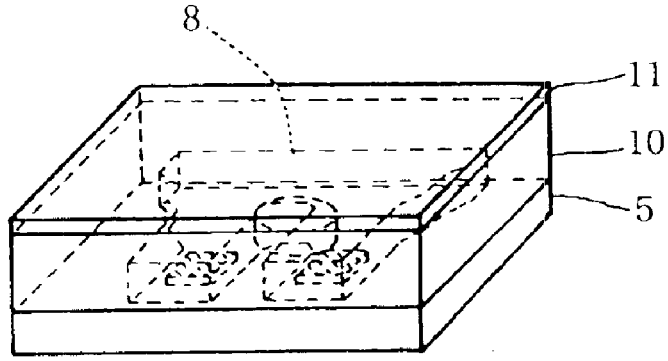
FIG. 6 depicts schematic illustration of the embodiment of manufacturing method of ink-jet recording head (step 6).

As FIG. 3 depicts, after a first photo-mask 9 having an opening corresponding to portions of mutually connected liquid paths and an ink-reservoir on the base plate 5 is placed over the resin layer 8, a photosensitive resin layer having a liquid path pattern is formed by exposing a light thorough the mask 9 and by developing the exposed resin layer 8. (See FIG. 4)

On the soluble photosensitive resin 8 where a liquid path pattern is formed, a liquid path forming material 10 is applied by the conventional methods such as spin coating and the roller coating etc.

As the material for the liquid path forming material 10, a photosensitive material is preferable, since the photosensitive material enables to form ejection ports more precisely and easily by employing a lithographic method. Liquid path forming materials require a high physical strength as a structure member, a good adhesion to the base plate 5, a durability against ink and a high resolution for patterning fine ejection ports. A cured epoxy resin by cationic polymerization bears the high physical strength, a good adhesive ability to the base plate and the durability against ink, and in addition, if the epoxy resin is solid at an ordinary temperature, the resin has an excellent property for patterning.

Since the epoxy resin cured by the cationic polymerization bears a high crosslinking density (high Tg: Tg stands for glass transition temperature) in comparison to cured resins by commonly used acid anhydrides or amines, it bears an excellent property as a structural member. In addition, by employing solid state epoxy resins at the ordinary temperature, diffusions of initiator seeds generated from cationic polymerization initiators by irradiating a light, into epoxy resins, are kept at so low level that patterns with excellent accuracy and shape are attained.

As solid state epoxy resins, an epoxy resin from bisphenol A and epichlorohydrin with molecular weight 900 or more, a reactant from bromo-bisphenol A and epichlorohydrin, a reactant from phenolic novolac or o-cresol novolac and epichlorohydrin, and multi-functional epoxy resins having oxycyclohexane skeletons disclosed for example, in the Japanese laid open patent Nos. 60-161973, 63-221121, 64-9216 and 2-140219, but the epoxy resins are not limited to the above-mentioned compounds.

When the above-mentioned epoxy resins are employed, resins with epoxy equivalent values of 2,000 or less, preferably 1,000 or less are desirable for the present invention. When the epoxy equivalent value exceeds 2,000, during cure reaction the crosslinking density is lowered and in some cases, Tg (glass transition temperature) of the product or a deformation initiating temperature is lowered, as the results the adhesive capability and the durability against ink of the product are deteriorated.

As initiators for photo-cationic polymerization for the above-mentioned epoxy resins, aromatic iodides, aromatic sulfates (cf. Japanese Polymer Science: Symposium No. 56 page 383, 1976) and initiators manufactured by Asahi Denka Kogyo Kabushiki Kaisha under the product names of SP-150 and SP-170 etc. are employable.

When a reducing agent is used with the above-mentioned initiators for photo-cationic polymerization under a heating condition, the cationic polymerization can be accelerated (the crosslinking density is increased in comparison to a case without reducing agent). However, when the initiator of the photo-cationic polymerization and the reducing agent are used together, it is necessary select the reducing agent so as to initiate the polymerization over certain temperature level (preferably over 60° C.) where the initiator acts as a so-called redox type initiator.

As the reducing agents mentioned above, a cupric compound, namely, cupric triflate (cupric trifluoromethanesulfanate) is most suitable, particularly when reactivity and solubility of the reducing agent in epoxy resin are taken into consideration. Another reducing agent such as asocorbic acid etc. is also useful. When the high crosslinking density (i.e. high Tg) is required for increasing orifice number (for a high speed recording) and for employing non-neutral ink (to improve water durability of pigment in ink) and so forth, the requirement can be attained by immersing and heating the resin film layer in a solution of the reducing agent after the developing procedure which will be explained below.

In addition, it is possible to add additives to the above-mentioned epoxy compounds, if necessary. For example, a flexibility enhancing agent can be added to decrease the elasticity of the epoxy resin or a silane coupling agent can be added to increase adhesive strength with the base plate and so forth.

A liquid path forming material 10 as a first active energy ray setting resin having formulation 1 described below, is coated over the base plate 5 by a spin coating and then is baked at 90° C. for 3 minutes by a hot plate.

| | | Part by weight |
|---|---|---|
| Formulation 1: | EHPE-3150 (trade name, produced by Daicel Chemical Ind. Ltd.) | 100 |
| | SP-170 (trade name, produced by Asahi Denka Kogyo Kabushiki Kaisha) | 1.5 |
| | diethyleneglycol dimethylether | 100 |

An ink-repellent material 11 (Formulation 2) mentioned below is applied on the liquid path forming material 10 so as to have a 1 $\mu$m thickness by a micro-spray system, a product of Nordson Co. Ltd. and is baked at 80° C. for 3 minutes by the hot plate (see FIG. 6). Since the solvent is evaporated and dried during flying through the atmosphere by pulverizing the ink-repellent material 11, the mutual solubility between the ink-repellent material and the liquid path forming material is remarkably reduced to an extent that virtually the solubility becomes insignificant.

| | | Part by weight. |
|---|---|---|
| Formulation 2: | EHPE-3150 (same as the Formulation 1) | 34 |
| | 2-2 Bis(4-glycidyl hydroxy phenyl) hexafluoro propane | 25 |
| | 1–4 Bis(2-hydroxy hexafluoro isopropyl) benzene | 25 |
| | 3-(2-perfluoro hexyl) ethoxy 1–2 epoxy propane | 16 |
| | A-187 (trade name, produced by Nippon Unicar Ltd). | 4 |
| | SP-170 (same as the Formulation 1) | 1.5 |
| | diethyleneglycol dimethylether | 200 |

Figure 7:
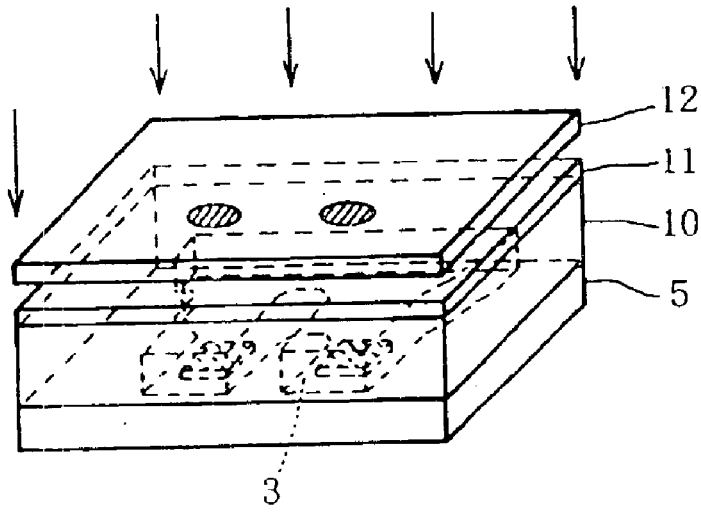
FIG. 7 depicts schematic illustration of the embodiment of manufacturing method of ink-jet recording head (step 7).
Figure 8:
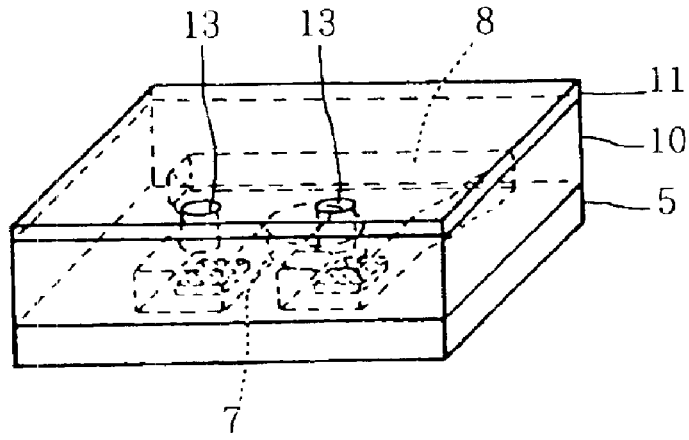
FIG. 8 depicts schematic illustration of the embodiment of manufacturing method of ink-jet recording head (step 8).
Figure 9:
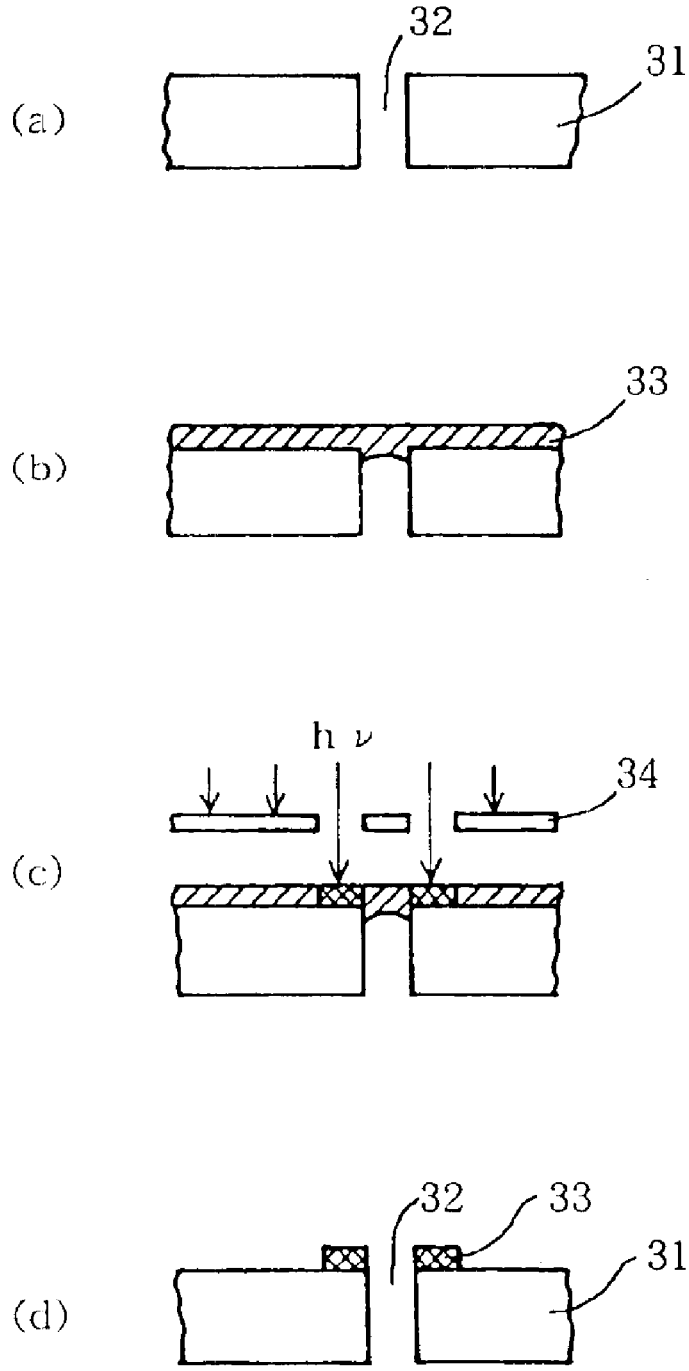
FIG.9 (PRIOR ART)
FIGS. 9*a*, 9*b*, 9*c* and 9*d* illustrate a successive procedure of forming ink-repellent layer according to a conventional photolithography.

As shown in FIG. 7, the applied ink-repellent material 11 and the liquid path forming material 10 are exposed to a light with an energy intensity of 5 J/cm$^2$ by keeping ejection ports 3 shielded by a photo-mask 12, and then are baked at 80° C. for 4 minutes by the hot plate, and is developed by xylene to form ejection ports (see FIG. 8).

The base plate 5 is irradiated with a deep UV light and after removing remained portions of ODUR1010 used as the phtosensitive material 8, by methyl isobutyl ketone (hereinafter referred to as "MIBK"), is baked at 200° C. for an hour, thus a ink-jet recording head is obtained.

Embodiment 2

In this embodiment the ink-repellent layer is applied by the procedure mentioned below while other procedures are carried out in the same way as in the above-mentioned embodiment.

The liquid path forming material on the base plate 5 is coated with a compound having the formulation 2 by printing 6 times with a flexo-printing machine IN-151 (trade name, produced by Nippon Photographic Printing Co. Ltd.) so as to attain the coated compound with a 1 μm thickness, and is baked at 80° C. for 3 minutes by the hot plate.

Embodiment 3

In the above-mentioned embodiments 1 and 2, the problem of the mutual solubility between the ink-repellent material 11 and the liquid path forming material 10 is not eliminated completely. This embodiment can completely prevent such a problem. In this embodiment the ink-repellent layer is applied by the procedure mentioned below, while other procedures are same as the previous embodiments. A PET (polyethylene terephthalate) film with a 50 μm thickness is coated with a compound having the above-described formulation 2 by a micro-gravure painting machine NCR-230 (trade name, produced by Yasui Precision Co. Ltd.) so as to attain the coated compound with a 1 μm thickness. The coated film is dried at 80° C.

The coated side of the dried film is applied on the liquid path forming material on the base plate 5, and is heated at 90° C. for a minute by applying a pressure of 4 Kg and the PET film is peeled off after cooling the film so as to leave the ink-repellent material on the base plate. In this embodiment the mutual solubility is prevented by applying the ink-repellent material 11 in the form of the dried film on the liquid path forming material.

In order to prove good performance of the present invention, reference ink-jet recording heads are produced as described below.

Reference 1

In this reference except an applying procedure of the ink-repellent material mentioned below, the other procedures are same as the embodiment 1. The liquid path forming material 10 on the base plate is coated with the compound having the formulation 2 by a spin coating machine so as to attain the coated compound with a 1 μm thickness and baked at 80° C. for 3 minutes by the hot plate.

Reference 2

An ink-jet recording head is manufactured in the same way as the embodiment 1 before applying an ink-repellent material. Then ejection ports and liquid paths are formed on the same conditions as the embodiment 1 without applying the ink-repellent material. After that the ink-repellent material is applied according to the following procedure. If ejection ports are already formed, compound having the formulation 2 seals ejection ports, since the concentration of ingredients in the compound is too high. In order to solve this problem, the base plate 5 is coated 6 times with a thinner compound having a formulation 3 (which is described below) by a flexo-printing machine IN-151 (trade name, produced by Nippon Photographic Printing Co. Ltd.) so as to attain a thickness of the coated compound by 0.07 μm, is baked at 80° C. for 3 minutes by the hot plate and is exposed from the front side on the entire surface with an energy intensity of 5 J/cm$^2$. After removing remained portions of ODUR1010 (positive type resist) corresponding to the liquid paths and the reservoir of ink by MIBK, the base plated 5 is baked at 200° C. for an hour, thus the manufacturing procedure of a ink-jet recording head is completed.

| | | Part by weight |
|---|---|---|
| Formulation 3 | EHPE-3150 (same as the Formulation 1) | 34 |
| | 2-2 Bis(4-glycidyl hydroxy phenyl) hexafluoro propane | 25 |

-continued

| | | Part by weight |
|---|---|---|
| | 1–4 Bis(2-hydroxy hexafluoro isopropyl) benzene | 25 |
| | 3-(2-perfluoro hexyl) ethoxy 1–2 epoxy propane | 16 |
| | A-187 (trade name, produced by Nippon Unicar Ltd. | 4 |
| | SP-170 (same as the Formulation 1) | 1.5 |
| | diethyleneglycol dimethylether | 3333 |

Reference 3

An ink-jet recording head is manufactured in the same way as the embodiment 1 before applying an ink-repellent material. Then ejection ports are formed on the same conditions as the embodiment 1 without applying the ink-repellent material. The surface of base plate where ejection ports are formed is coated with the compound having the above-mentioned formulation 2 by a spin coating machine so as to obtain 1 μm thick coated layer and baked at 80° C. for 3 minutes by the hot plate.

The ink-repellent material is exposed with an energy intensity of 5 J/cm$^2$ by shielding ejection ports 3 with a photo mask, is baked at 80° C. for 4 minutes by the hot plate and is developed by xylene, thus corresponding portions of ejection ports on the ink-repellent material are formed.

The base plate 5 is irradiated with a deep UV light and is baked at 200° C. for an hour after removing the photosensitive material ODUR1010 (trade name) by the above-mentioned MIBK, thus a finished ink-jet recording head is obtained.

The results of recording quality tests by using ink-jet recording heads manufactured by above-mentioned methods, are as follows: In the cases of references 1, 2 and 3, inferior recording qualities are observed due to uneven thickness of the coated ink-repellent agent, but in the case of the embodiments 1, 2 and 3 according to the present invention, such inferior qualities are not observed. Observations of ink status in these heads prove that in the cases of embodiments of the present invention, stable ink meniscuses are formed on the surfaces of ejection ports compared with those of references. Moreover, in these embodiments since by employing epoxy resins cured by the cationic polymerization, the ink-repellent materials show an excellent adhesive and physical properties, and keen-edged ejection ports are formed, which attains stable recording results.

In the case of reference 1, ink-repellent layer is coated unevenly and positions of ink meniscuses are randomly distributed due to the mutual solution between the ink-repellent material 11 and the liquid path forming material during the spin coating.

In the case of reference 2, positions of ink meniscuses are not firmly settled immediately after ejection due to subtle ink-repellent penetrations into ejection ports during flexo-printing. Ink repellent capability seems to be a little lower probably due to thinner ink-repellent layer.

In the case of reference 3, though irregular meniscuses in ejection ports are not observed, ejecting directions are not too uniform due to a generated 0.2 μm patterning gap during patterning the ink-repellent material and liquid path forming material.

As explained above, according to the present invention, recording qualities are highly improved due to the uniform formation of ink-repellent layer on the surface of ejection ports. Thus according to the present invention, the formation of the ink-repellent layer on the surface of ejection ports with high precision effect is realized to meet the high precision recording quality which requires fine structured ejection ports.

What is claimed is:

1. A method of manufacturing an ink-jet recording head, comprising the steps of:

preparing a base plate having an ink ejection pressure generating element and a liquid path pattern, which is removable, located on a part of the base plate that includes the ink ejection pressure generating element;

applying a first active energy setting material on the base plate and the liquid path pattern;

applying an ink-repellent second active energy setting material, which is dry, on the first active energy setting material before exposing the first active energy setting material;

forming an image pattern of an ejection port for ejecting ink, which image pattern is the same in both the first active energy setting material and the ink-repellent second active energy setting material, by exposing both the first active energy setting material and the ink-repellent second active energy setting material in a process by applying light to both the first active energy setting material and the ink-repellent second active energy setting material simultaneously through a mask corresponding to the ejection port for ejecting ink; and developing the image pattern formed in the preceding step in the first active energy setting material and the ink-repellent second active energy setting material so as to form the ejection port above the ink ejection pressure generating element.

2. The method of manufacturing the ink-jet recording head according to claim 1, wherein said step of applying the ink-repellent second active energy setting material on the first active energy setting material is performed by a method of spraying fine particles of the second material.

3. The method of manufacturing the ink-jet recording head according to claim 1, wherein said step of applying the ink-repellent second active energy setting material on the first active energy setting material is preformed by a flexographic printing method.

4. The method of manufacturing the ink-jet recording head according to claim 1, wherein said step of applying the ink-repellent second active energy setting material on the first active energy setting material is performed by a method of transforming the second active energy setting material into a dry film and applying the film on the base plate.

5. The method of manufacturing the ink-jet recording head according to claim 1, wherein the first active energy setting material is an epoxy resin cured by cationic polymerization.

6. The method of manufacturing the ink-jet recording head according to claim 1, wherein the ink-repellent second active energy setting material is an epoxy resin cured by cationic polymerization.

* * * * *

UNITED STATES PATENT AND TRADEMARK OFFICE

CERTIFICATE OF CORRECTION

PATENT NO. : 6,895,668 B2
APPLICATION NO. : 09/526173
DATED : May 24, 2005
INVENTOR(S) : Isao Imamura It is certified that error appears in the above-identified patent and that said Letters Patent is hereby corrected as shown below:

COLUMN 1
Line 14, “referred” should read --referred to--.
Line 32, “referred” should read --referred to--.

COLUMN 2
Line 31, “a” should read --an--.
Line 38, “a” should read --an--, and “shown” should read --shown in--.
Line 40, “is formed” should be deleted.

COLUMN 3
Line 12, “purposes” should read --purpose--.
Line 17, “of;” should read --of:--.
Line 28, “second energy” should read --second energy active--.
Line 35, “wherein;” should read --wherein--.
Line 40, “wherein;” should read --wherein--.
Line 44, “wherein;” should read --wherein--.
Line 49, “wherein;” should read --wherein--.
Line 53, “wherein;” should read --wherein--.
Line 57, “with” should read --by--.

COLUMN 4
Line 67, “easily” should read --easily be--.

COLUMN 6
Line 3, “asocorbic” should read --ascorbic--.
Line 37, “virtually the solubility becomes” should read --the solubility becomes virtually--.
Line 60, “phtosensitive” should read --photosensitive--.
Line 62, “a” should read --an--.

UNITED STATES PATENT AND TRADEMARK OFFICE

CERTIFICATE OF CORRECTION

PATENT NO. : 6,895,668 B2
APPLICATION NO. : 09/526173
DATED : May 24, 2005
INVENTOR(S) : Isao Imamura It is certified that error appears in the above-identified patent and that said Letters Patent is hereby corrected as shown below:

COLUMN 7

Line 13, “emboi-” should read --embodi- --.
Line 31, “except” should read --except for--.
Line 56, “plated 5” should read --plate 5--.
Line 58, “a” should read --an--.

Signed and Sealed this

Fifth Day of December, 2006

JON W. DUDAS
*Director of the United States Patent and Trademark Office*